United States Patent [19]

Salomon

[11] Patent Number: 4,484,762

[45] **Date of Patent: * Nov. 27, 1984**

[54] SKI BINDING AND BOOT

[75] Inventor: Georges P. J. Salomon, Annecy, France

[73] Assignee: Salomon S.A., France

[ * ] Notice: The portion of the term of this patent subsequent to May 10, 2000 has been disclaimed.

[21] Appl. No.: 408,845

[22] Filed: Aug. 17, 1982

Related U.S. Application Data

[63] Continuation of Ser. No. 116,847, Jan. 30, 1980, Pat. No. 4,382,611.

[30] Foreign Application Priority Data

Jan. 31, 1979 [FR] France ..... 79 02513

[51] Int. Cl.[3] ..... A63C 9/18

[52] U.S. Cl. ..... 280/615; 36/117

[58] Field of Search ..... 280/615

[56] References Cited

U.S. PATENT DOCUMENTS

| | | | |
|---|---|---|---|
| 3,861,700 | 1/1975 | Fredriksen | 280/615 |
| 4,082,312 | 4/1978 | Johnson | 280/615 |
| 4,108,467 | 8/1978 | Keyenbuhl | 280/615 |

FOREIGN PATENT DOCUMENTS

| | | |
|---|---|---|
| 222828 | 5/1909 | Austria . |
| 362720 | 10/1922 | Fed. Rep. of Germany . |
| 2715907 | 10/1977 | Fed. Rep. of Germany . |
| 2633373 | 2/1978 | Fed. Rep. of Germany . |
| 2350856 | 12/1977 | France . |
| 2382910 | 10/1978 | France . |
| 201026 | 1/1939 | Switzerland . |

*Primary Examiner*—Robert R. Song

*Attorney, Agent, or Firm*—Sandler & Greenblum

[57] ABSTRACT

A ski binding in combination with a boot or shoe adapted to be secured to a ski by the binding. The binding comprises a support element having an abutment zone and a latching element having a transverse bit. The latching element is adapted to be mounted on the boot and a moveable latch is provided which is adapted to exert a force for forcing a support zone provided on the boot against the abutment zone. A ski binding for securing one end of a boot or shoe comprising a support zone and comprising a latching element having a transverse bit to a ski. The binding comprises a support element adapted to be secured to the ski. The support element comprises an abutement zone and is adapted to be engaged between the transverse bit and the zone. The binding further comprises a moveable latch adapted to exert a force for forcing the support zone against the abutement zone. A shoe or boot for attachment to a ski with a binding. The shoe or boot comprises a support zone at one end thereof and a latching element. The latching element comprises a transverse bit. The shoe or boot is adapted to be secured to the ski with a binding which comprises a latch and a support element. The latching element is spaced from a support zone provided on the shoe or boot. The space provided is adapted to fit over the support element whereby the support zone and the abutement are pressed to rigidly mate against one another.

2 Claims, 40 Drawing Figures

SKI BINDING AND BOOT

This is a continuation of application Ser. No. 116,847 filed Jan. 30, 1980, now U.S. Pat. No. 4,382,611.

BACKGROUND OF THE INVENTION

Field of the Invention

The present invention relates to a device for connecting one end of a boot to a ski.

SUMMARY OF THE INVENTION

It is an object of the invention to provide a binding for attachment of one end of a boot or shoe to a ski.

It is a further object of the invention to provide a binding for use in skiing where the skier lifts one end of the shoe or boot off of the ski.

These and other objects are fulfilled by means of the ski binding of the invention in combination with a boot or shoe adapted to be secured to a ski by the binding. The binding comprises a support element adapted to be mounted on the ski which comprises an abutment zone. The binding further comprises a latching element comprising a transverse bit. The latching element is mounted on the boot. The combination further comprises a moveable latch adapted to exert a force for forcing a support zone provided on the boot against the abutment zone.

The invention is further directed to the ski binding alone as well as to the shoe or boot alone or in combination with the ski binding.

In its broadest sense the ski binding for binding a boot or shoe having a support zone to a ski comprises a support element and a moveable latch. The support element comprises an abutment zone adapted to mate with the support zone of the shoe or boot.

BRIEF DESCRIPTION OF THE DRAWINGS

With reference to the annexed drawings, illustrating non-limiting embodiments of the invention:

FIG. 7 illustrates the initial phase of boot insertion;

FIG. 8 illustrates the passage phase of the elbow joint;

FIG. 9 illustrates the locked position;

FIGS. 23 and 24 illustrate a first embodiment in which the support element is rigidly mounted on the ski specifically;

FIG. 23 is a lateral elevational view of a first embodiment;

FIG. 24 is a side elevational undetailed elevational view on a reduced scale illustrating the raising of the heel of the shoe or boot.

FIG. 25 illustrates a partial lateral elevational view of a second embodiment of the invention in which the support element is integral with a flexible portion;

FIG. 26 is a non-detailed elevational view on a reduced scale, illustrating how the heel of the boot or shoe is raised when the support element is integral with a flexible portion;

FIG. 27 is perspective view illustating an alternative preferred embodiment of the mounting of the flexible portion with the support element being integral with the flexible portion;

FIG. 28 is a lateral view illustrating how the shoe or boot pivots as the heel is lifted with the support element being integral with the flexible portion;

FIG. 29 is a perspective view of a third embodiment in which the support element is pivotably mounted around a transverse axis;

FIG. 30 is a lateral elevational view illustrating how the shoe or boot is raised off of its heel;

DESCRIPTION OF PREFERRED EMBODIMENTS

Figure 1:
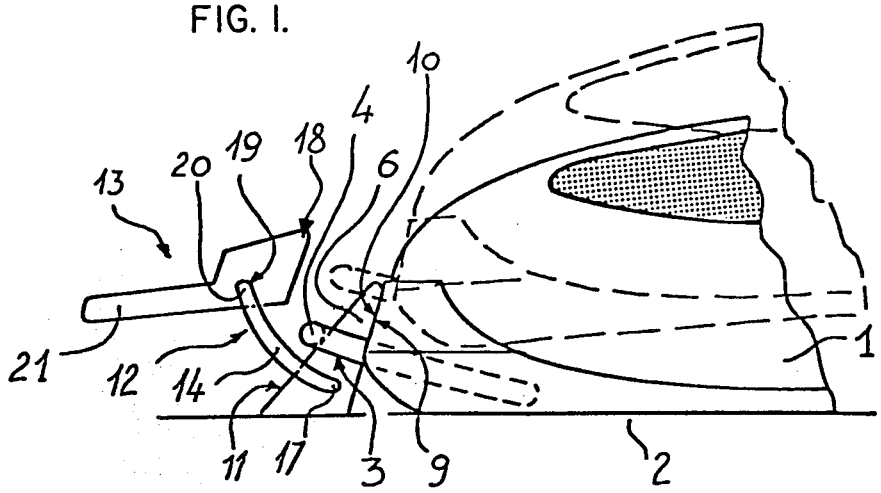
FIG. 1 is a side elevational view of a first embodiment of a device of the invention during insertion of the boot.

Although the device of the invention may be used as an element connecting the front and/or the rear of the shoe or boot in ski assemblies used for downhill skiing, the device of the invention is more particularly adapted as disclosed in the instant application as a binding adapted to connect the front of the shoe or boot to the ski, while the heel of the boot may be freely lifted as is the case in cross-country or mountaineering type skiing (ski de fond and ski de randonnee in French) as well as in ski jumping.

In its most general aspect, the device of the invention is a connecting device in which:

(a) the shoe comprises, arranged along its longitudinal axis, a latching element rigidly connected to the front end of the boot, this latching element having a bit arranged transversely to the longitudinal axis of the boot, and is fixed with respect to the front end and spaced therefrom;

(b) a support element for the end of the boot is connected to the ski and is adapted to engage itself between the transverse bit of the latching element and the front of the boot. The support element has, on the side of the boot, an abutment zone for the end of the boot being held; and (c) a moveable latch for exerting a bias or pressure on the latching element assuring the application of the end of the boot being held in abutment against the abutment zone of the support element.

Advantageously, the latching element comprises a stirrup made out of steel wire which may, for example, have a circular cross section, whose transverse bit is parallel to the upper surface of the ski.

According to one aspect of the invention, the support element extends substantially perpendicularly to the upper surface of the ski and transversely to the longitudinal axis of the ski while the latching element has the shape of a buckle such that the positioning of the foot before locking is accomplished by vertical movement from top to bottom of the front of the foot for assuring the introduction of the support element into the latching element. As a result, there is no risk of the ski slipping on the snow during insertion of boot as would be the case if insertion occured in a plane parallel to the ski.

The support element may thus be fixed in a rigid fashion with respect to the ski, either by means a flexion element or mounted pivotably with respect to the ski.

As has been previously indicated, the front of the boot is held against the support element by virtue of a latch.

Advantageously, the latch of the invention comprises a journaled mounting and a moveable element journaled on the mounting, and further comprises at least one pressure nose adapted to cooperate with bit of the latching element. The latch can be displaced between inactive and active positions in which the pressure nose is elastically applied against the bit of the latching element by virtue of the tensioning of a deformable elastic portion of the latch system.

The elasticity of latch allowing for its latching may be achieved by various techniques. For example, one may use an elastically deformable mounting which may comprise a curved shaft having a U-shape whose median member acts a journal for the pressure element (which may in this case be a rigid element) and whose lateral arms are shaped so as to elastically deform along their length. Alternatively, the elasticity may be achieved using a mounting comprising links which are journaled but nondeformable. In this instance, it is a portion of the pressure element which is elastically deformed. According to yet another embodiment, both the mounting and the pressure element are both adapted to be elastically deformed. Similarly, a spring independent of the mounting may be provided to assure the bias of the mounting.

According to a preferred embodiment, the front zone of the boot supported against the support element has a contour which engages the support element. In effect, to achieve good retention of the front of the boot with respect to the support element, it is necessary to eliminate any possibility of rotation of the boot around the transverse bit of the latching element.

Figure 2:
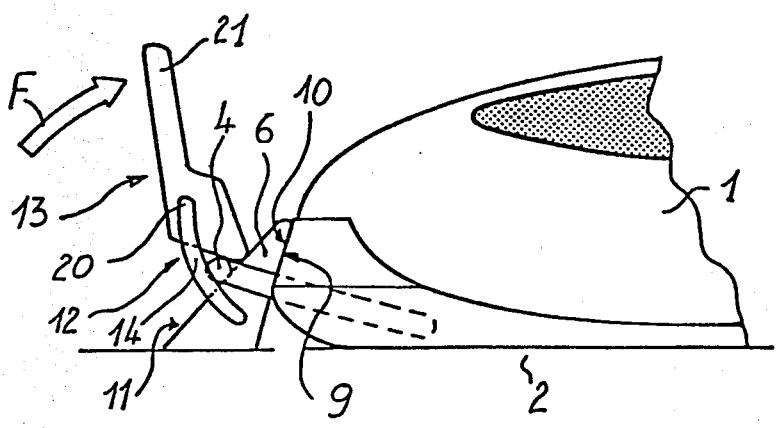
FIG. 2 is a side elevational view of the device of FIG. 1 before locking.
Figure 3:
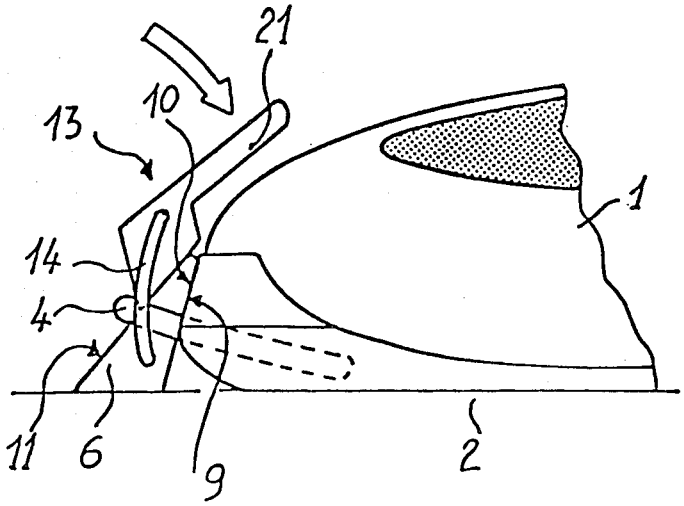
FIG. 3 is a side elevational view of the device shown in FIGS. 1 and 2 in the locked position during skiing.
Figure 4:
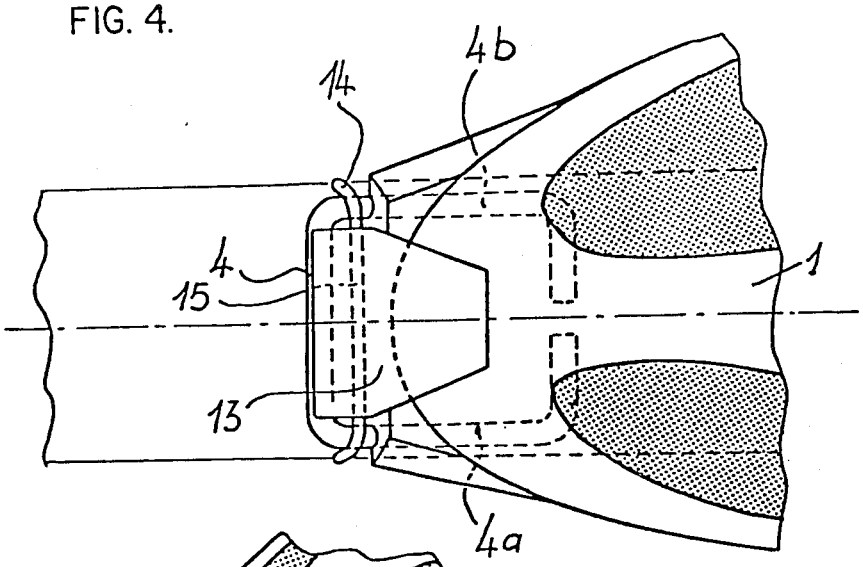
FIG. 4 is a top view of the device in the position illustrated in FIG. 3.
Figure 5:
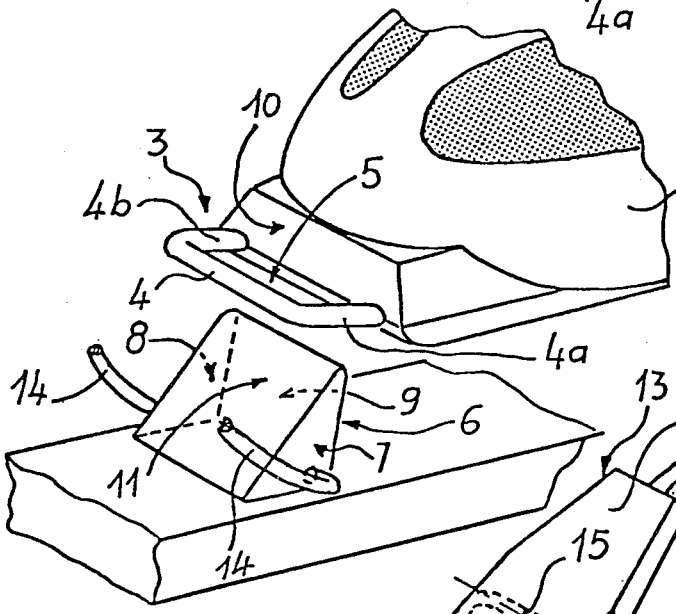
FIG. 5 is a perspective view of the device of FIGS. 1–4 during the boot insertion procedure.
Figure 29:
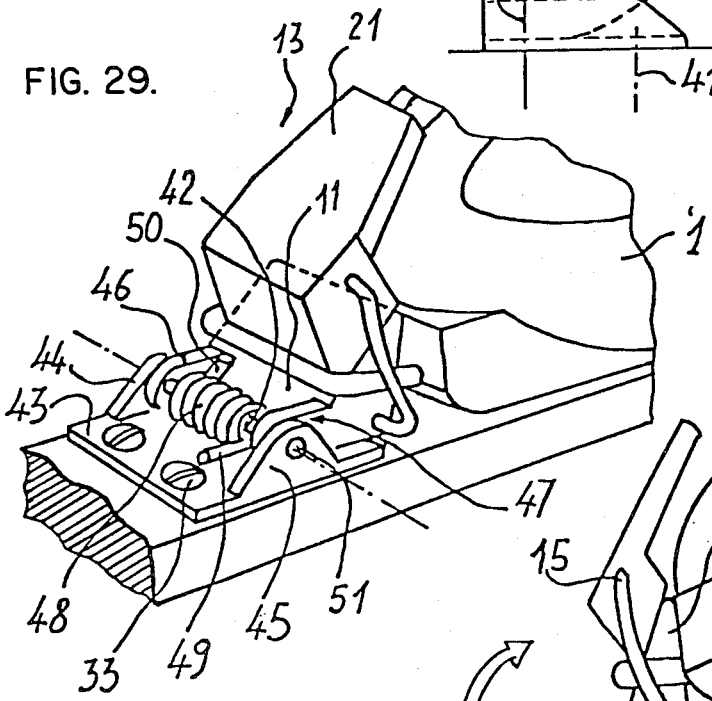
Figure 30:
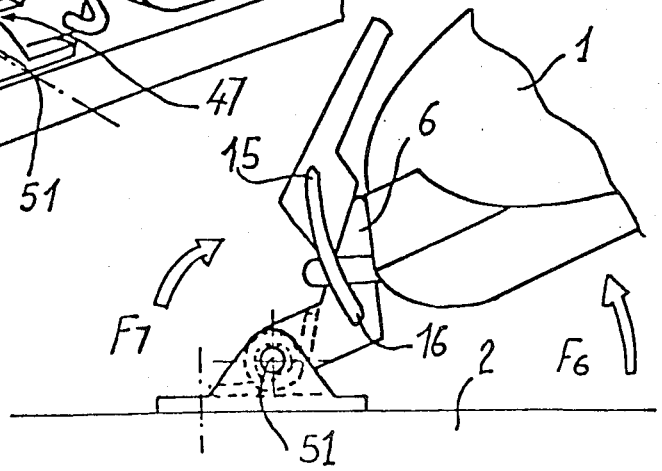

According to the first embodiment shown in FIGS. 1–3, the boot 1 comprises at its front portion, a latching element or portion 3 molded therein whereby it is rigidly fixed to the shoe. This element extends outwardly from the front of boot. The latching element preferably comprises a cylindrical steel wire in the shape of a ring (see FIG. 4). The latching element comprises a transverse bit 4 and two lateral arms 4*a* and 4*b* which may be fixed to the boot, for example, by being molded therein. The transverse bit 4 is spaced from the front of the boot and extends therefrom to provide an opening 5 (see FIG. 5) adapted to be engaged over a support element 6 during the insertion of boot onto the ski which is performed by a vertical displacement of boot as is shown in dashed and continuous lines in FIG. 1. The support element 6 is advantageously in the form of a projection extending transversely above the surface of the ski 2. The support element is connected to the ski 2 either so as to be fixed with respect thereto (FIGS. 23–24), or in an elastic fashion (FIGS. 25–28), or in a manner so as to be pivotable on the ski (FIGS. 29–30). In FIGS. 1–22, the support element is shown as being integral with the ski 2, but it is quite obvious that all different types of support elements can be connected to the ski by means such as are illustrated in FIGS. 23–30 without leaving the scope of the invention.

Support element 6 may be in the form of a projection having an inverted-V shape extending between bit 4 and front 2 of the boot being positioned in opening 5 reserved for this reason. The support element extends transversely between arms 4*a* and 4*b* of the latching element which thereby assures the lateral retention of the boot by virtue of the cooperation of the lateral arms with the lateral surfaces 7 and 8. Furthermore, the support element comprises an abutment zone 9 cooperating with the corresponding support zone 10 of the front of the boot. Additionally, the support element comprises an incline or support zone 11 adapted to cooperate with the transverse bit of the latching element. The two support zones 9 and 11 are preferably planar and form a dyhedral between them.

The boot is maintained with respect to the support element by virtue of a retention system or latch comprising journaled mounting 12 and pressure element 13 journaled on the mounting. The mounting comprises a stirrup having a generally U-shape made out of a shaped cylindrical steel wire. This stirrup has two lateral arms 14, connected by a transverse member 15 on which the pressure element 13 is rotatably mounted. The lateral arms 14 have their free end 16 curved and engaged in a pivotable fashion in the bore of geometrical axis 17, appropriately provided in the support element 6. As may be seen in the drawings, lateral arms 14 are curved so as to allow for the elastic deformation of the mounting which is necessary for latching. The moveable pressure element comprises a pressure portion or nose 18 adapted to cooperate with transverse bit 4 of the latching element 3.

Figure 6:
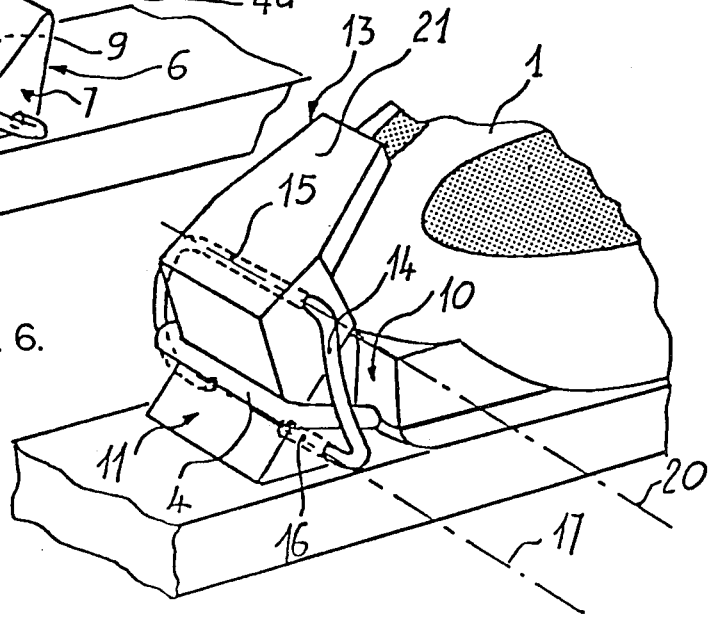
FIG. 6 is a perspective view of the assembly in the locked position corresponding to FIG. 3.

Nose 18 advantageously extends transversely as may be seen in FIG. 6. Furthermore, the pressure element comprises a bore 19 providing a geometrical axis 20 for bit 15 of the stirrup.

Figure 10:
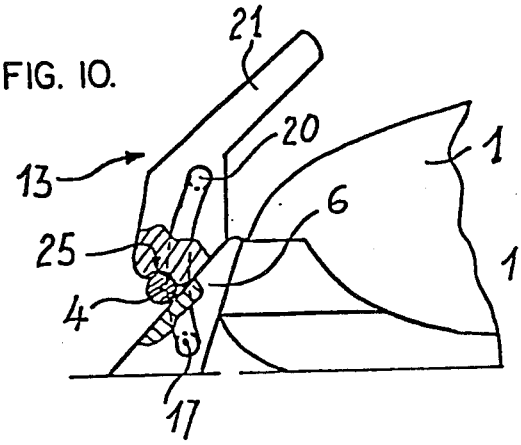
FIG. 10 illustrates one alternative embodiment of the latch.
Figure 11:
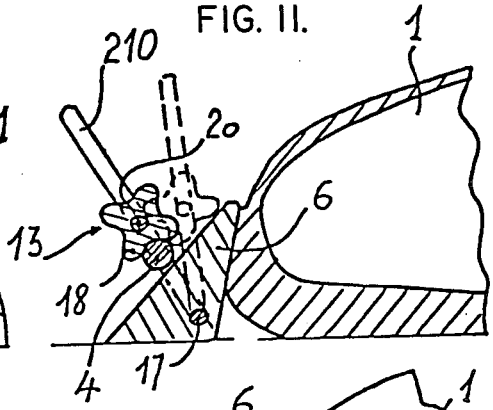
FIG. 11 is an alternative latch embodiment in partial cross section.

FIGS. 10 and 11 illustrate alternative embodiments of pressure noses which may be used in conjunction with the moveable pressure element. Beyond the axis 20, the pressure element comprises a projection or extension 21 acting as a lever for the manipulation of the element. The moveable element is adapted to hold the latching element to bias the front 10 of the boot against the support element. To ensure this retention, the retention system or latch is of the "elbow" type comprising the stirrup 12 and the moveable element 13. This type of device makes it possible to achieve elevated pressures for elastic systems which are simple and which have a relatively low energy.

Figure 7:
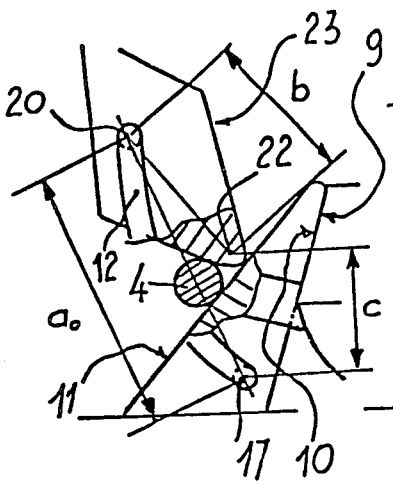
FIGS. 7–9 schematically illustrate partial exploded views showing the locking procedure, specifically.
Figure 8:
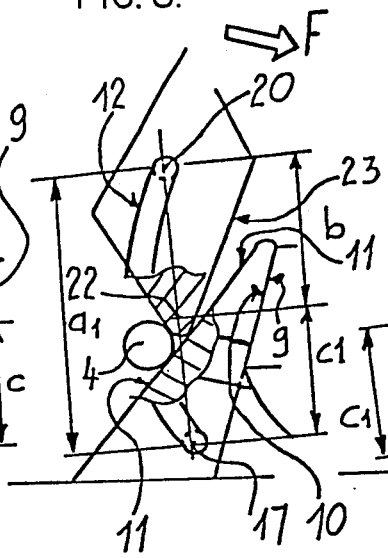
Figure 9:
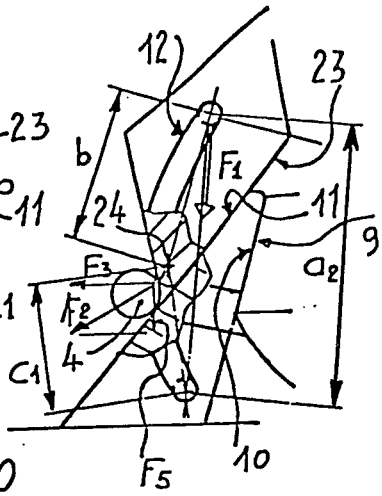

The boot is inserted within the binding by engaging the latching element 3 above and over the support element 6 (see FIG. 1). The support element is thus positioned between the transverse bit 4 and the front of the boot 10 in the opening 5 provided for this purpose. The moveable pressure element 13 and particularly the pressure nose 18 is subsequently brought adjacent to the bit 4 (FIG. 2). The device is then locked (FIG. 3) by drawing lever 21 towards the rear in the direction of the arrow F. FIGS. 7, 8 and 9 schematically illustrate the principle behind this type of latch.

FIG. 7 illustrates on a magnified scale, the position shown in FIG. 2. The instantaneous axis of rotation of moveable element 13 is designated as 22. It will be noted that axis 22 of the pressure nose is positioned to the right of the plane defined by the axes 20 and 17 as shown in the Figures. In effect the distance $a_o$ separating the axes 20 and 17 is shorter than the sum b+c which are the distances separating the axis of rotation 22 from the axis 20 on the one hand and the axis of rotation 22 from the axis 17 on the other hand.

FIG. 8 illustrates the device in the intermediate position, i.e., the position corresponding to the passage of the dead point of the elbow joint against the force of the elastic system which, in the embodiment shown, comprises the stirrup. In this position, it will be noted that $a_1$ which is the distance between 17 and 20 is greater than a and that $a_1$ is equal to $b+c_1$, $c_1$ being substantially equal to c. In this position, the axis 22 is in the plane defined by the axis 20 and 17. The retention system is thus considered to be in an unstable equalibrium state. In order to latch the device, lever 21 need only be further pivoted to the rear in the direction of arrow F to place it in the position of FIG. 9. In this position, it will be seen that the axis 22 has moved to the left of the plane defined by the axes 20 and 17 (with reference to the drawings) and that the face 23 of the element 13 is supported against the face 11 of the support element; element 13 thus being in an equilibrium position.

In this position, the elastic element comprising stirrup 12 biases mobile element 13 in the direction of arrow $F_1$ (downwardly) while the pressure nose 18 is abutted against, on the one hand bit 4 of the latching element, and on the other hand, against face 11 of the support element. At the point of contact 24 between the nose 18 and the bit 4 pressure element 13 biases bit 4 in the direction of arrow $F_2$ which is inclined towards the front of the ski and downwardly towards the ski.

The horizontal component of bias $F_2$ which is illustrated by arrow $F_3$ is oriented parallel to the ski and it extends along the longitudinal axis of the boot in the direction of the end of the ski comprising the extension of the latching element, i.e., towards the front of the ski in the examples shown. This component $F_3$ thus causes the advancement of the boot which causes the front of the boot to be forced against the support element and thus to flatten the face 10 of the front of the boot against the face 9 of the support element. On the other hand, the vertical component $F_5$ of the bias $F_2$ has a tendency to squeeze the support element in the opening 5, the support element thus acting as a wedge.

FIG. 10 illustrates another embodiment of the moveable retention element or latch 13. In this embodiment the pressure nose comprises a transverse cross section having a hollow region 25 which cooperates in the course of insertion of the boot particularly with the bit 4.

FIG. 11 illustrates an alternative embodiment where the moveable element is a roller 13 rotatable mounted on the stirrup and comprising a plurality of pressure noses 18. A maneuvering lever 210 in this embodiment is integral with the stirrup.

Figure 12:
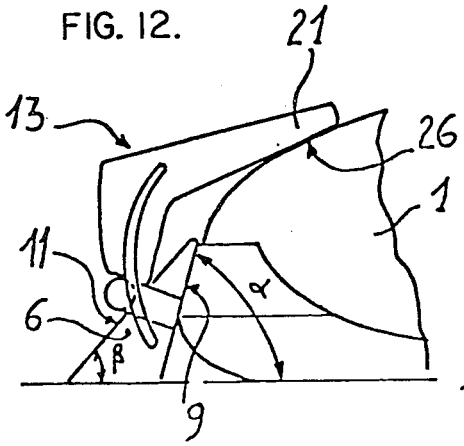
FIG. 12 shows another alternative embodiment of the latch.

FIG. 12 illustrates another embodiment in which the maneuver lever 21 of the moveable retention element or latch is supported against a portion of the boot 26.

According to a preferred embodiment the abutment surface 9 of support element is planar and forms an angle $\alpha$ which is between 0° and 90° with the surface of the ski while the inclined surface 11 of the support element is also planar and forms an angle $\beta$ between 0° and 90° with the surface of the ski (see FIG. 12)

Figure 13:
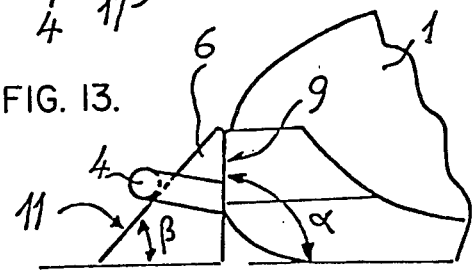
FIG. 13 illustrates one embodiment of the support element and the front of the boot (the latch not being shown)

FIG. 13 illustrates an alternative support element wherein angle $\alpha$ is equal to 90° and angle $\beta$ is between 0° and 90°.

Figure 14:
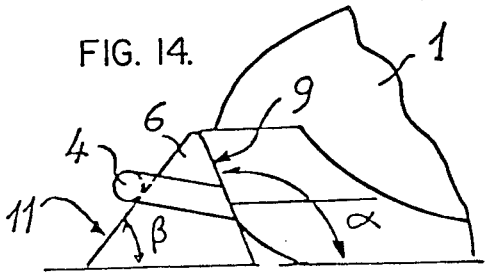
FIG. 14 illustrates an alternative support element.

FIG. 14 is another embodiment in which $\alpha$ is between 90° and 180° and $\beta$ is between 0° and 90°.

Figure 15:
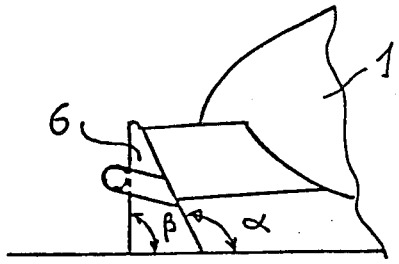
FIG. 15 illustrates yet another support element.

FIG. 15 illustrates yet another embodiment wherein $\alpha$ is between 90° and 180° and wherein $\beta$ is equal to 90°.

It should be noted that the front face 10 of the boot must be flattened against the face of the support element and must for this reason have the same angle of inclination with respect to the ski.

Naturally, it should be understood that both $\alpha$ and $\beta$ can be equal and may both be equal to 90°.

Figure 16:
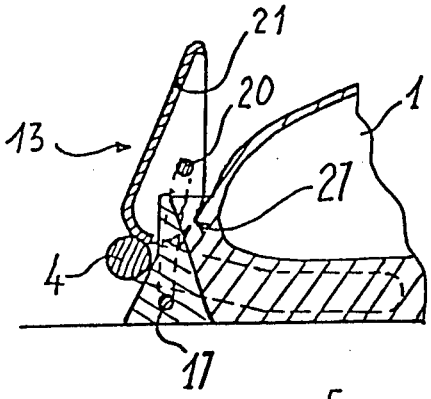
FIG. 16 illustrates a longitudinal cross-sectional view of one embodiment of the invention.

FIG. 16 is an alternative embodiment of FIG. 12 wherein the moveable retention element or latch 13 is supported on the transverse bit 4 and equally on the boot in front of the boot and laterally on both sides of the support element at 27 respectively.

Figure 17:
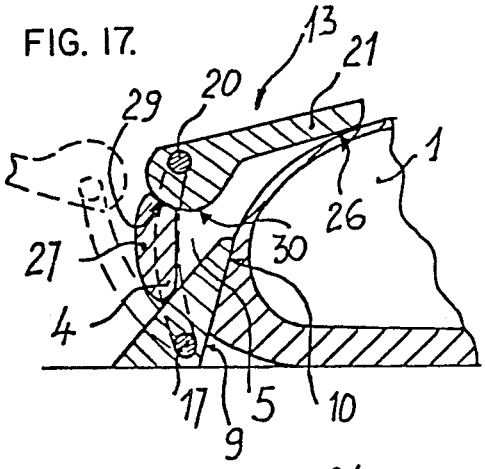
FIG. 17 is a cross-sectional view illustrating another embodiment of the invention.
Figure 18:
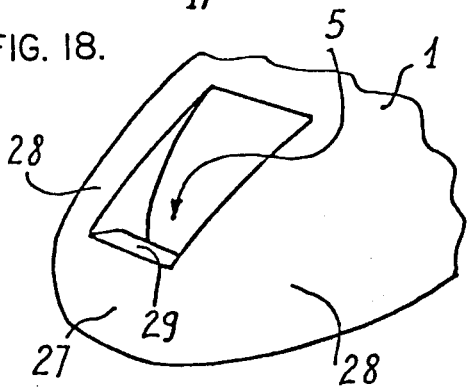
FIG. 18 is a perspective view illustrating the end of the boot used in conjunction with the embodiment of FIG. 17.

FIG. 17 illustrates another embodiment of the latching element integral with the boot. In this embodiment, the buckle extends vertically at 27 and laterally at 28 to form an opening 5 extending vertically. The assembly may be integral with the boot as shown. The moveable latching element is supported on the boot at 26 as shown in FIG. 12 and at 29 on the latching element by means of cam 30 provided on the retention element 13.

Figure 19:
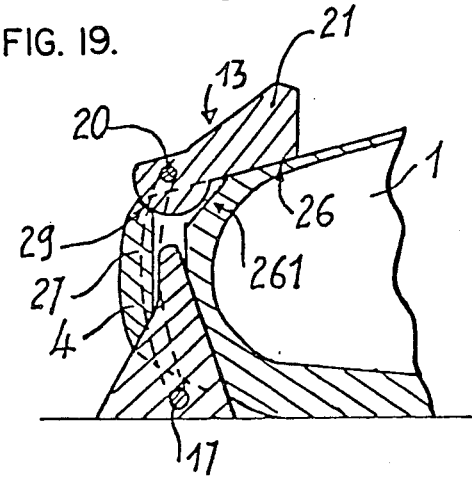
FIG. 19 is a longitudinal cross-sectional view of another embodiment of the invention.
Figure 20:
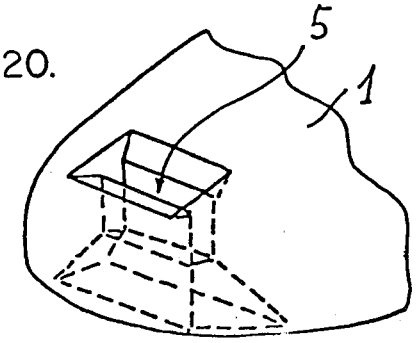
FIG. 20 is a perspective view of the end of the boot utilized in conjunction with the embodiment of FIG. 19.
Figure 21:
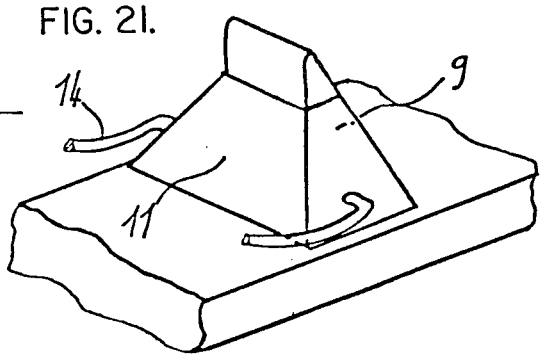
FIG. 21 is a perspective view of the contour of the support element shown in FIG. 19.

FIGS. 19, 20 and 21 illustrate another embodiment in which the support element 9 has a substantially pyramidal shape. It will be noted that the moveable element can be supported at 26 or at 261.

Figure 22:
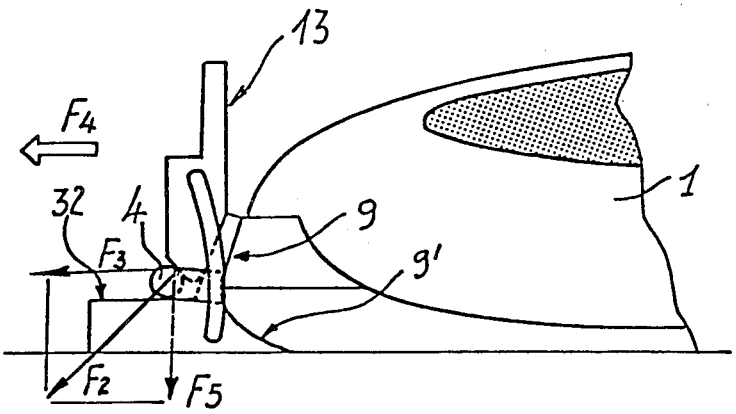
FIG. 22 illustrates a lateral elevational view of another embodiment of the invention.

FIG. 22 shows an alternative embodiment in which the support element comprises two support zones 9 and 9' for the boot. The force $F_2$ of the retention element or latch 13 on the bit 4 has a horizontal component $F_3$ and causes the frontward displacement, in the direction of the arrow $F_4$, of the boot to flatten the front of the boot against the support element at 9 and 9'.

It should be noted that the bit 4 is in contact on the surface 32 of the support element by virtue of the action of force $F_2$ which is downwardly directed. The bit 4 is biased toward the surface 32 at a force equal to $F_5$ ($F_5$ being the vertical component of $F_2$). The horizontal component $F_3$ is the force which tends to bias the front of the boot against the support element.

Figure 23:
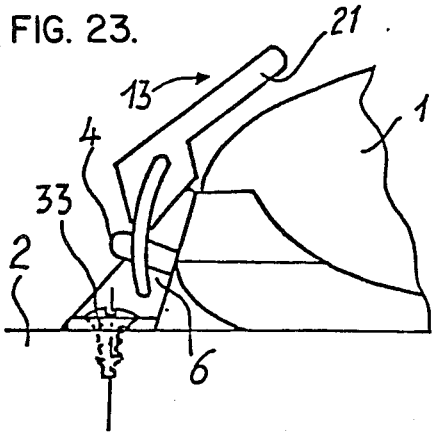
FIGS. 23–30 illustrate the mounting of the support element with respect to the ski, specifically.
Figure 24:
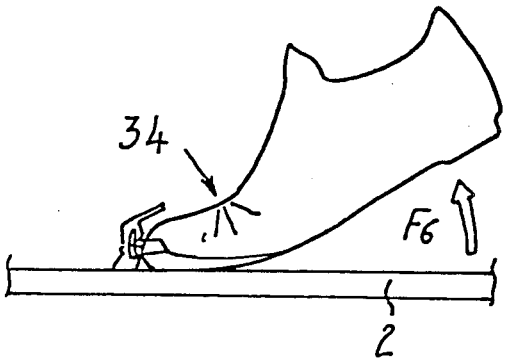
Figure 25:
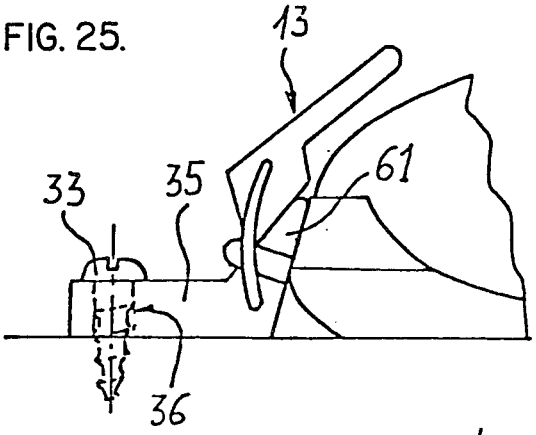

FIGS. 23 and 24 illustrate a first linkage embodiment between the support element and the ski. In these arrangements, the support element 6 is connected to the ski 2 in a rigid and fixed fashion by virtue, for example, of screws as shown in FIG. 23. The lifting of the heel in the direction of the arrow $F_6$ results from the flexion of the boot at 34 (see FIG. 24).

Figure 26:
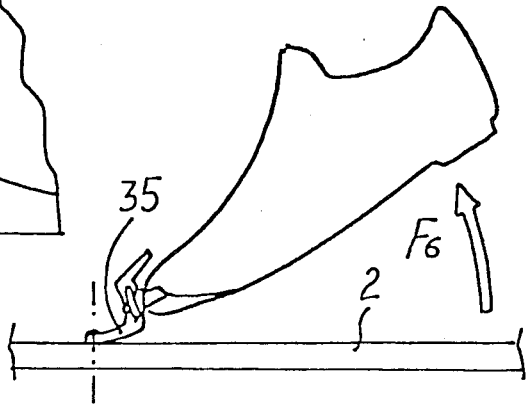
Figure 27:
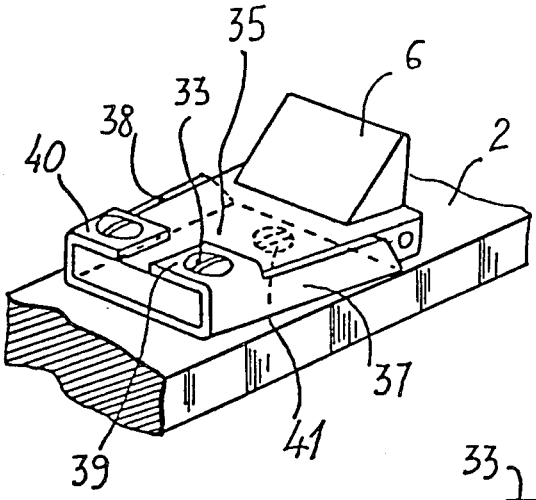
Figure 28:
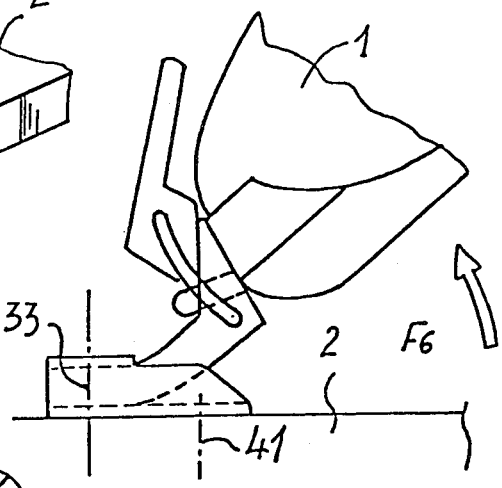

FIGS. 25, 26, 27 and 28 illustrate another linkage embodiment between the support element and the ski. In this second embodiment, the support element is connected to the ski by means of a flexion element. Thus, the support element 61 is integral with a flexion element 35 fixed to the ski by screws 33. To this end the flexion element 35 comprises holes 36 for the passage of the screw 33 provided at the opposite end to the end where the support element 61 is located. The raising of the heel of the boot in the direction of the arrow $F_6$ occurs by flexion of the flexion element 35, the support element itself thus being raised from the surface of the ski (FIGS. 26 and 28).

Figure 31:
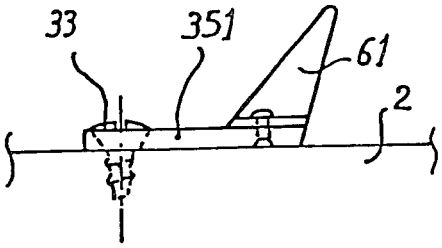
FIG. 31 illustrates alternative elevational views of the support element alone according to another embodiment.
Figure 32:
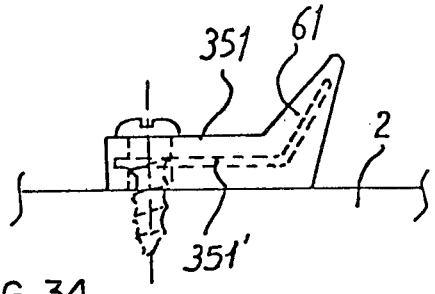
FIG. 32 is an lateral elevational view of yet another embodiment of the support element alone.

Preferably, the support element 61 and the flexion element 35 are unitarily constructed and are made out of a single piece of elastic material. However, the arrangement may be varied, such as, the support element can be metallic and can be fixed on a flexion blade 351 made out of steel (see FIG. 31). One can also provide a metallic insert 351' in the monobloc elastic structure discussed above (FIG. 32).

FIGS. 27 and 28 illustrate one preferred mounting of the flexion element. To this end an intermediate element or metallic base comprising two lateral vertical edges 37 and 38 is provided for laterally retaining the flexion element 35 while permitting the raising or lifting as shown in FIG. 28. Furthermore, two flaps 39 and 40 of the metallic base are horizontally folded over to retain the screws 33 more rigidly. A third screw 41 fixing the base itself to the ski can also be provided while the two screws 33 retain the base and the end of the flexion element 35 on the ski.

FIGS. 29 and 30 illustrate another means for linking the support element to the ski. In this embodiment, the support element 6 is pivotably connected to the ski such that it can pivot around a transverse axis to shaft shaped 42. To this end, the support element is mounted on an intermediate element or baseplate 43 screwed onto the ski by means of screws 33 and two vertical upstanding members 44 and 45 provided with a hole for the passage of the shaft 42. The support element comprises two lower extensions 46 and 47 which are frontwardly directed and which have a hole for the passage of the shaft 42. A torsion spring 48 is mounted around the shaft 42 and comprises two ends. End 49 is supported on the base plate 43 while end 50 is supported on the face 11 of the support element. The spring biases the support element 6 in the direction of the arrow $F_7$. The shaft 42 can be riveted at its two ends.

In the embodiments shown in FIGS. 25–30, by virtue of action of the spring 48, the heel of the ski is raised along the direction of the arrow $F_6$ (FIG. 30) to press itself against the heel of the boot.

Figure 33:
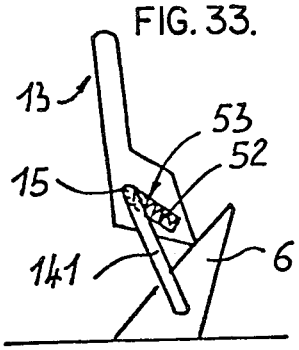
FIG. 33 is a lateral perspective view of an alternative embodiment of the latch.
Figure 34:
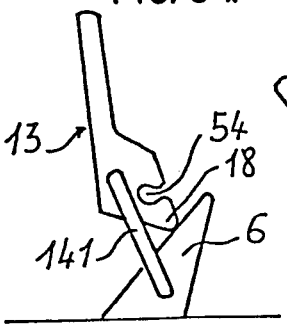
FIG. 34 illustrates a lateral perspective view of yet another latch embodiment.
Figure 35:
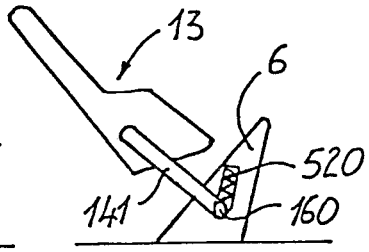
FIG. 35 is lateral perspective view of yet another latch.

FIGS. 33, 34 and 35 illustrate two alternative embodiments of elbows comprising the latch 13. In these embodiments, the elastic bits 14 of the preceeding embodiments are replaced by links 141 which are rigid and wherein the necessary elasticity for the latching is provided by an element other than the links. In FIG. 33, the elasticity results from a spring 52 arranged in a slit 53 of element 13 which biases the transverse member 15 of the links 141 on which the pressure element pivots.

As shown in FIG. 34, the elasticity results from element 13 itself which comprises a depression 54 which provides the necessary flexibility to the pressure nose 18 when this nose is in contact with the latching element.

In FIG. 35 a spring 520 is arranged in the support element 6 and serves to bias the arms 160 of the links 141.

Figure 36:
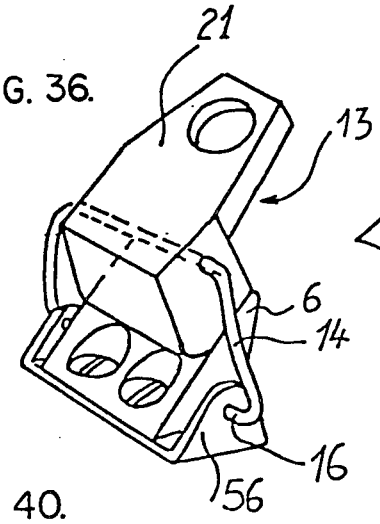
FIG. 36 is a perspective view illustrating an alternative mounting of the retention system.

FIG. 36 illustrates an embodiment wherein the axes 16 do not pivot in the support element but rather in an intermediate element 56. The support element and intermediate element assembly are mounted on the ski 2 either on the flexion element 35 or in rotation around a shaft 42.

Figure 37:
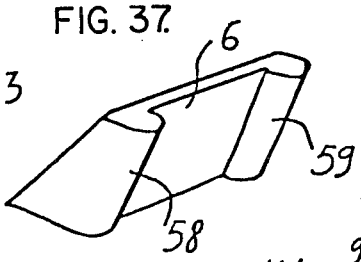
FIG. 37 is a perspective view of yet another alternative embodiment of the support element.
Figure 38:
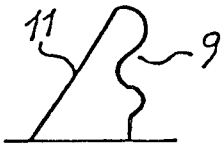
FIG. 38 is a lateral elevational view of the support element for the shoe or boot.

In the preferred embodiments of the invention the support zones 9 and 11 of the support element are advantageously planar. However these zones may assume other forms and particularly the forms shown in FIG. 37 wherein the support occurs at two ridged edges 58 and 59 which are substantially vertical. This means may be used for the face 9 or for the face 11 or both. Alternatively, as shown in FIG. 38 the edges can be horizontal.

It should be noted that the moveable pressure element may comprise one or more holes so that it may be manipulated with the end of a ski pole as shown in FIG. 36.

As was discussed above, to achieve good retention of front of the boot, it is necessary that the support element be rendered integral with the boot in an efficacious fashion. The boot must, therefore, be prevented from turning around the transverse bit in particular. To accomplish this, the support zone of the boot supported against the support element must have contour which fully engages the support zone of the support element as completely as possible.

Figure 39:
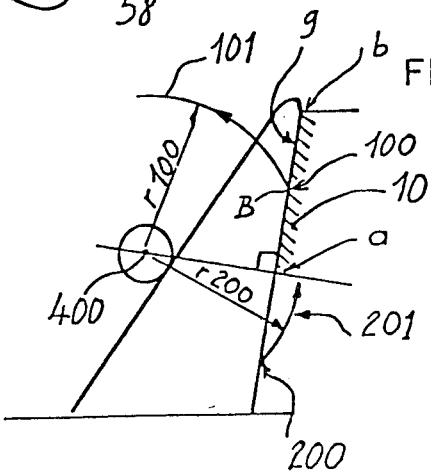
FIG. 39 is a schematic representation illustrating how the front of the shoe or boot is supported.

FIG. 39 illustrates on magnified scale an elevational view of a support element 6 with the front of the boot and the transverse bit. As may be seen from this figure, one realizes what occurs when one walks with the ski, i.e., when the heel of the boot is raised. If one considers the point 100 of the face 10 of the front of the boot, it will be noted that its circular trajectory 101 centered around point 400 (the center of the bit) of the radius r100 cuts the support surface 9 corresponding to the support element at B which means that the boot abuts against the support element at B without being able to escape. It will also be noted that the lower point 200 of the front of the boot has a circular trajectory 201 which is centered at 400, radius r200, which is spaced from the support surface 9 corresponding to the support element. It will be noted that the support zone which is best suited for retaining the front of the boot is the zone ab situated above the plane passing through the axis of the transverse portion of the latching element and perpendicular to the support plane (or at the tangent of the support zone if this zone is curved). In summary, the points must have an engaging form with respect to the support element to avoid that the boot turns around the transverse bit and is, on the contrary, integrally held with respect to the support element.

Figure 40:
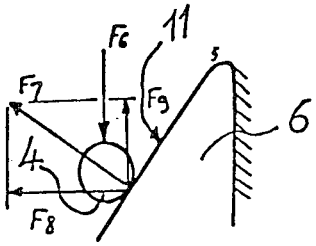
FIG. 40 is a force diagram showing the reaction force of the support element on the latching element.

FIG. 40 shows how the horizontal biasing of the boot occurs when the reaction force of the latch is essentially vertical. This condition corresponds to a force in the direction of arrow $F_6$. Under these conditions the reaction force of face 11 of the support element on bit 4 is $F_7$ which has a vertical component $F_9$ equal to $F_6$ but in the opposite direction. $F_8$ is the horizontal component which biases the shoe frontwardly.

While the invention has been described with respect to both shoes and boots, it is to be understood that the invention is not limited to any one form of shoe and encompasses instead all shoes, boots and the like used in conjunction with bindings of the type disclosed and without limitation to the materials of construction.

Furthermore, while the invention has been described with specific reference to particular support elements, latches, and the like it is to be understood that the invention is not limited to those specifics disclosed but extends to all embodiments falling within the scope of the claims.

What is claimed:

1. A ski binding for securing one end of a boot or shoe having a support zone to a ski, said binding comprising:

(a) a support element adapted to be mounted on said ski, said support element comprising an abutment zone;

(b) a latching element adapted to be mounted on said boot;

(c) a movable latch adapted to exert a force for forcing said support zone of said boot against said abutment zone, wherein said support element is adapted to be disposed between said latching element and said support zone.

2. The ski binding of claim 1 wherein said latching element has an open space formed therein.

* * * * *